US009472877B1

(12) United States Patent
Hoffmeyer

(10) Patent No.: US 9,472,877 B1
(45) Date of Patent: Oct. 18, 2016

(54) TWISTED EYE-OF-NEEDLE COMPLIANT PIN

(71) Applicant: International Business Machines Corporation, Armonk, NY (US)

(72) Inventor: Mark K. Hoffmeyer, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/867,037

(22) Filed: Sep. 28, 2015

(51) Int. Cl.
*H01R 13/42* (2006.01)
*H01R 12/71* (2011.01)
*H01R 43/20* (2006.01)

(52) U.S. Cl.
CPC ..... *H01R 12/71* (2013.01); *H01R 43/205* (2013.01)

(58) Field of Classification Search
CPC .... H01R 12/72; H01R 43/205; H01R 25/00; H01R 12/7064
USPC ..... 439/751, 638, 816
See application file for complete search history.

(56) References Cited

U.S. PATENT DOCUMENTS 4,655,537 A * 4/1987 Andrews, Jr. ..... H01R 12/585 439/751
7,249,981 B2 7/2007 Chen
2006/0274483 A1 12/2006 Porter et al.
2007/0081311 A1 4/2007 Iwamiya et al.
2008/0166928 A1 7/2008 Tang
2013/0337697 A1 12/2013 Buschel et al.
2014/0273639 A1 9/2014 Larsen et al.

FOREIGN PATENT DOCUMENTS

EP 2518117 A1 10/2012
WO 2013165649 A1 11/2013
WO 2014058577 A1 4/2014

OTHER PUBLICATIONS

Goodman et al., "Technical adaptation under Directive 2002/95/EC (RoHS)—Investigation of exemptions", ERA Report 2004-0603, Dec. 2004, pp. 1-79, Copyright ERA Technology Limited 2004.
Hoffmeyer, M., "Eye-Of-Needle Compliant Pin", U.S. Appl. No. 14/867,035, filed Sep. 28, 2015.
List of IBM Patents or Patent Applications Treated as Related, Sep. 25, 2015, 2 pages.

* cited by examiner

*Primary Examiner* — Javaid Nasri
(74) *Attorney, Agent, or Firm* — Robert C. Bunker

(57) ABSTRACT

An eye-of-needle (EON) compliant pin that includes a compliant segment including two opposing spring arms defining a substantially planar opening. The Eon compliant pin includes a twisted segment connected between a top portion of the compliant segment and a bottom portion of a length segment. The compliant segment, the length segment, and the twisted segment together form a substantially straight solid body. The twisted segment is twisted about a longitudinal axis of the substantially straight solid body such that the substantially planar opening of the compliant segment is rotated at an angle with respect to the length segment.

20 Claims, 6 Drawing Sheets

New Via Before Compliant Pin Insertion

After Compliant Pin Insertion

After Compliant Pin Removal

After Compliant Pin Rework

TWISTED EYE-OF-NEEDLE COMPLIANT PIN

BACKGROUND

The present disclosure relates to electrical connectors, and more specifically, to electrical connectors secured to electrical vias by resiliently gripping conductive material of the vias.

An electrical connector is an electro-mechanical device for joining electrical circuits at an interface using a mechanical assembly. Each connector can comprise a mating segment. The mating segment can include a header segment (male-ended) or a receptacle segment (female-ended). The electrical connectors can be grouped together in a set of one or more within a single connector body. The connector body can be configured to house electrical connectors that include header segments, female segments, or both. The electrical connectors can be inserted into a device, such as a printed circuit board that includes electrical vias in order to maintain an electrical connection between the printed circuit board and another electrical device. The electrical connection may be temporary (as for portable equipment), require a tool for assembly and removal, or serve as a permanent electrical joint between two wires or devices. There are hundreds of types of electrical connectors. Electrical connectors can include compliant pins, and more specifically eye-of-needle (EON) compliant pins.

SUMMARY

According to embodiments of the present disclosure, aspects of the present disclosure are directed towards an eye-of-needle (EON) compliant pin that can include a compliant segment that comprises two opposing spring arms defining a substantially planar opening. The EON pin can further include a twisted segment connected between a top portion of the compliant segment and a bottom portion of a length segment. The compliant segment, the length segment, and the twisted segment can together form a substantially straight solid body. The twisted segment can be twisted about a longitudinal axis of the substantially straight solid body such that the substantially planar opening of the compliant segment is rotated at an angle with respect to the length segment.

According to embodiments of the present disclosure, aspects of the present disclosure are directed towards a method. The method can include identifying a plurality of eye-of-needle (EON) compliant pins connected to a printed circuit board (PCB). A connector body can house the plurality of EON pins. The method can further include removing the plurality of EON compliant pins from the PCB. A plurality of sets of contact points can have been created where two opposing spring arms of each of the plurality of EON compliant pins were engaged in corresponding inner surfaces of each of a plurality of electrical vias of the PCB. The method can further include inserting a plurality of twisted EON complaint pins into the corresponding plurality of electrical vias of the PCB at a plurality of different sets of contact points. Each of the plurality of twisted EON compliant pins can comprise a compliant segment comprising two opposing spring arms defining a substantially planar opening. Each of the plurality of twisted EON compliant pins can further comprise a twisted segment connected between a top portion of the compliant segment and a bottom portion of a length segment. The compliant segment, the length segment, and the twisted segment together can form a substantially straight solid body of each twisted EON compliant pin. The twisted segment of each twisted EON compliant pin can be twisted about a longitudinal axis of the substantially straight solid body such that the substantially planar opening of the compliant segment is rotated at an angle with respect to the length segment.

According to embodiments of the present disclosure, aspects of the present disclosure are directed towards a method. The method can include identifying an eye-of-needle (EON) compliant pin connected to a printed circuit board (PCB). The method can further include removing the EON compliant pin from the PCB. The EON complaint pin can create a set of contact points where two opposing spring arms of the EON compliant pin were engaging an inner surface of an electrical via of the PCB. The method can further include inserting a twisted EON complaint pin into the electrical via of the PCB at a different set of contact points. The twisted EON compliant pin can include a compliant segment that comprises two opposing spring arms defining a substantially planar opening. The twisted EON compliant pin can further include a twisted segment connected between a top portion of the compliant segment and a bottom portion of a length segment. The compliant segment, the length segment, and the twisted segment can together form a substantially straight solid body. The twisted segment can be twisted about a longitudinal axis of the substantially straight solid body such that the substantially planar opening of the compliant segment is rotated at an angle with respect to the length segment.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
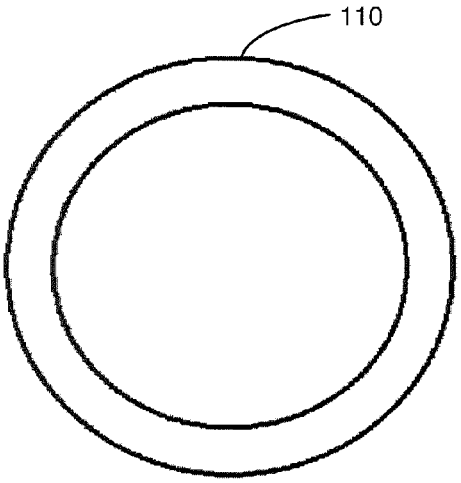
FIG. 1A, FIG. 1B, FIG. 1C, and FIG. 1D depict cross sectional views of contact points between one or more compliant pins and an electrical via during a reworking process, according to embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to electrical connectors, more particular aspects relate to the electrical connectors secured to electrical vias by resiliently gripping conductive material of the vias. While the present disclosure is not necessarily limited to such applications, various aspects of the disclosure may be appreciated through a discussion of various examples using this context.

Eye-of-needle (EON) compliant pin connectors are commonly used in high performance computing systems as they can have numerous assembly process advantages. These advantages may include the ability to circumvent a need for use of high stress soldering operations involving solder compositions. This can be an important advantage in high component density, thick, high-layer-count printed circuit boards, where large surface mount connectors or pin-in-hole solder tail connectors cannot be processed effectively due to the high thermal mass of the complex constructions without specialized tools, fixtures, and selective solder reflow processes.

In recent years, the menu of available EON compliant pin connectors has expanded to accommodate increasing demands for a higher density of connections within a given amount of electronic packaging space. As a result, compliant pin connectors are now available in a number of reduced pitches and pin sizes, and terms like "standard", "mini", and "micro" compliant pin technology are used to describe the different compliant pin connector types. Obviously, since these connector types vary in EON compliant pin size, each of these connector types can require use of a different finished printed circuit board's electrical via size and array size to match the pin size, as specified by the connector supplier. This can lead to a decrease in the likelihood of a good electrical contact when the EON compliant pins are inserted into electrical vias and also decrease the likelihood of long term reliability within an assembled application.

Manufacturers of EON compliant pins and manufacturers of printed circuit boards sometimes have different size standards and are not in communication when developing a size for their instruments. Without careful control of the dimension of a hole of the electrical via and plating parameters, printed circuit board (electrical via) damage can develop due to stresses resulting from EON compliant pin insertion and rework reinsertion steps. This damage can include but is not limited to electrical via cracks and interplane separation.

Of a possible greater importance, is the fact that even when boards are processed with optimal plated through hole characteristics (preferred plating thickness and recommended hole diameters), rework operations can drive the creation of defects because of general hardware tolerances, and because of the fact that, during reworking, compliant pins can scour over common deformed barrel areas created upon initial connector insertions. These conditions can lead to either card damage or insufficient EON compliant pin retention force within the printed circuit board.

On complex printed circuit boards, the rework of EON compliant pin connectors can be very common (specifically their removal followed by reinsertion of new EON compliant pins) and can poses additional challenges to avoid electrical circuit board damage, latent reliability issues, or yield loss. In these situations, a common region within a through hole barrel can be subjected to high stresses during EON compliant pin insertion. In addition, complex printed circuit boards can also possess various attributes and process challenges that do not necessarily allow for compliant pin plated through holes to be manufactured with optimal plating thicknesses or hole diameters. These limitations can create a narrow margin for rework success and reliability assurance, and in general multiple insertion reworks may not be allowed.

Turning to FIG. 1A, a cross-sectional view of an electrical via 110 prior to insertion of an EON compliant pin can be seen, according to various embodiments. The electrical via 110 can include various conducting metals that can carry an electrical signal from the EON pin to the electrical via. For example, the electrical via can be a material, such as copper, aluminum, gold, or silver. The electrical via can be in an array that includes a plurality of electrical vias within a printed circuit board.

When providing hole plating compensation processes to accommodate overall functional reliability of electrical vias, the electrical vias can become exceedingly small. In many instances finished hole sizes for some electrical vias end up at upper specification limits for functionality and reliability. This can lead to electrical vias that may not match up with EON compliant pins. When this scenario results, an ability to assemble or rework reliably with EON compliant pin connections can become compromised, sometimes resulting in the scrapping of printed circuit board assemblies. Several problems can drive this yield loss, including electrical conduction loss from an EON compliant pin.

Other problems can occur during reworking. Rework problems can include insufficient normal force and retention forces for compliant pin reinsertions to ensure contact reliability. More specifically, during reworking, a diameter size of an electrical via can become too large in the local insertion region to support adequate normal force and stored energy of opposing spring arms of an EON pin. This can happen because the reinserted pin must traverse across previously deformed material in the electrical via, which effectively can create hole diameters that are too large. In other situations, in particular when compliant pin plated through holes are at the low end of specification for diameter and plating thickness, board damage upon initial insertion or rework reinsertion can result. Types of damage can include, for example, electrical cracks or laminate printed circuit board inter-plane separation.)

Figure 1B:
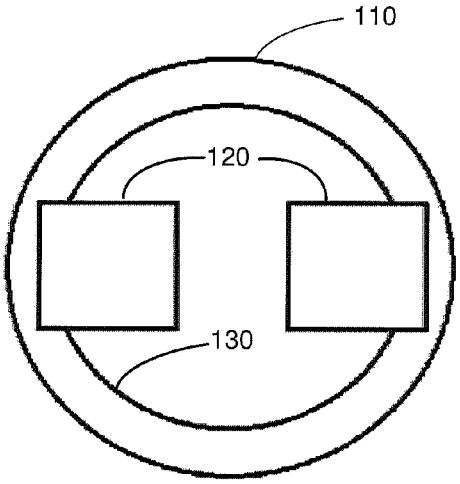

In FIG. 1B, a cross-sectional view of a pair of opposing spring arms 120 of an EON pin extending outward against an inner surface 130 of the electrical via 110 can be seen, according to embodiments. A normal force exerted by the opposing spring arms 120 upon the inner surface 130 can cause a portion of the electrical via 110 to compress. This compressing of the material can, in some cases, cause damage to the material and consequently to the electrical conducting properties of the electrical via 110. This damage can affect the flow of electricity from the EON compliant pin to the printed circuit board and thus can affect electrical components that are used in conjunction with the printed circuit board. The normal force can depend on the size of the EON pin and the diameter of the inner surface 130 of the electrical via 110. The normal force can be necessary in order to keep the EON pin in place within the electrical via, so that movement of the EON pin within the electrical via can be decreased.

When using EON compliant pin connector technologies that possess different interconnect pitches and reduced pin sizes on complex electric circuit board cross sections, various challenges can emerge that can impact potential post assembly connector reliability. Specifically, on complex boards that possess high aspect ratio plated thru holes, it can be very difficult for an electric circuit board supplier to fine tune electrical via operations to accommodate a number of compliant pin sizes reliably and effectively with tight tolerance controls.

In effect, the above challenges can drive a need for printed circuit board suppliers to use different drill whole sizes and plating thickness ranges that depart from parameters that are typically specified and qualified by the EON compliant pin connector vendors in order to provide boards with final holes sizes that are within the specified target ranges. These adjustments can drive a very careful balancing act that can require electric wiring board vendors to couple drill hole size adjustments with multiple copper electrolytic plating bath plating process adjustments to increase the likelihood of proper finished electrical via sizes that could support reliable EON compliant pin connector insertion and adequate plating thickness on most electrical vias of all sizes for long term reliability.

Figure 1C:
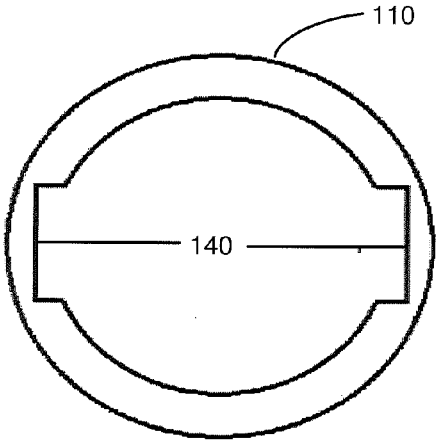

In FIG. 1C, a cross-sectional view of an electrical via 110 after removal of an EON pin from the electrical via 110 can be seen, according to embodiments. In embodiments, indentations 140 in the electrical via 110 caused by the opposing spring arms 120 exerting an outward force can be seen. Removing the EON pin from the electrical via could be due to routine maintenance. Removing the EON pin from the electrical via 110 could cause damage to the electrical via 110, or the normal force exerted by the opposing spring arms 120 could cause damage. Damage can also be caused by reinserting the same or a substantially similar EON pin into the electrical via, such that upon reinsertion the EON pin is in contact with the indentations 140.

In some embodiments, creating a twisted segment in the EON pin to be reinserted can result in the EON pin engaging the inner surface 130 of the electrical via 110 at a different set of contact points (e.g., contact points not in the indentations 140). This can reduce the damage to the electrical via caused during reworking.

To increase the likelihood of reliable rework and extended reworkablility of EON compliant pin connectors, a twisted segment may be introduced into an EON pin. In some embodiments, the twisted segment that can be used to rotate the contact orientations of the EON compliant pin within the electrical via upon reinsertion. Having this different set of contact points within the electrical via can, in some embodiments, increase the likelihood of uniform insertion and consistent insertion force, as well as minimize impact for excessive inner surface deformation that could lead to damage of the printed circuit board.

Figure 1D:
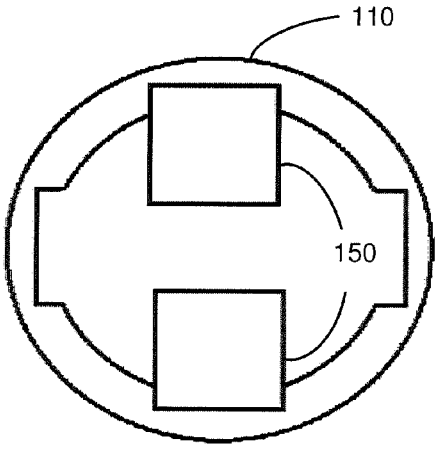

Now turning to FIG. 1D, a cross-sectional view of a second pair of opposing spring arms 150 that are rotated substantially orthogonal to the pair of opposing spring arms 120 within the electrical via 110 can be seen, according to embodiments. This orthogonal rotation could be due to an introduction of a twisted segment within a second EON pin. In embodiments, the second pair of opposing spring arms 150 can be the pair of opposing spring arms 120 resulting from twisting the EON compliant pin. The second EON can include a twisted section that results in the second pair of opposing spring arms 150 engaging the inner surface 130 of the electrical via 110 at a different set of contact points. The contact of the second pair of opposing spring arms 150 with the different set of contact points of the electrical via 110 could reduce the likelihood of damaging the electrical via 110 during reworking.

A third EON pin could be inserted after removal of the second EON pin. This third EON pin could include a twisted section that results in a rotation of the spring arms such that, when inserted, the spring arms engage the inner surface 130 of the electrical at yet another set of new contact points of the electrical via. For example, the rotation could be thirty degrees, forty-five degrees, or sixty degrees with respect to the indentations 140. This reworking process could continue with each subsequent EON pin containing a twisted section that includes a rotation that could result in each subsequent EON pin engaging the inner surface 130 of the electrical via at a plurality of different sets of contact points.

Figure 2B:
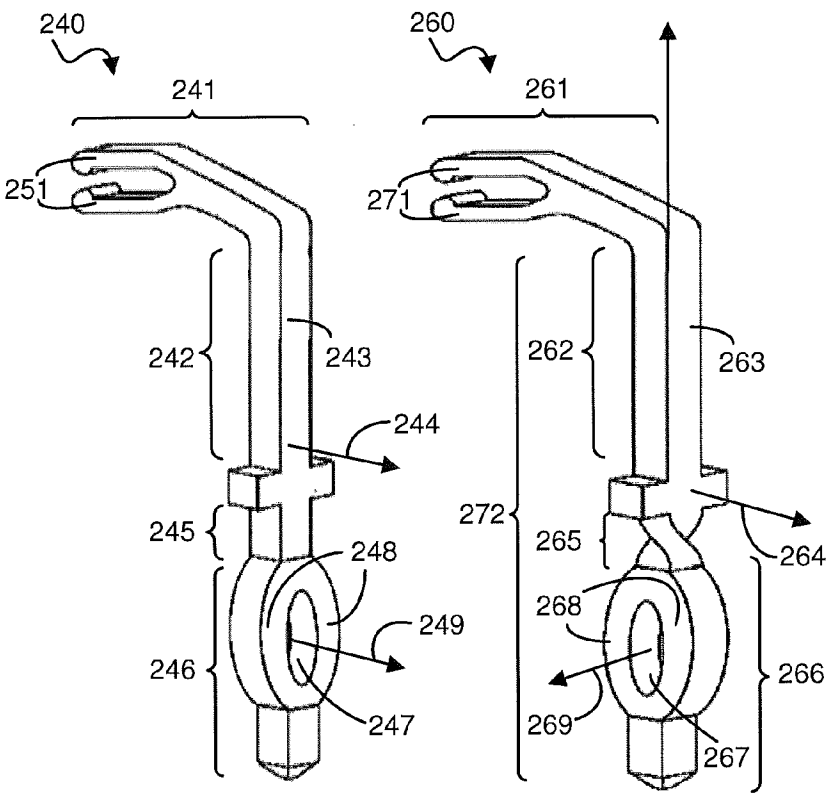
FIG. 2B depict a twisted and untwisted compliant pin with a header segment, according to embodiments of the present disclosure.
Figure 2A:
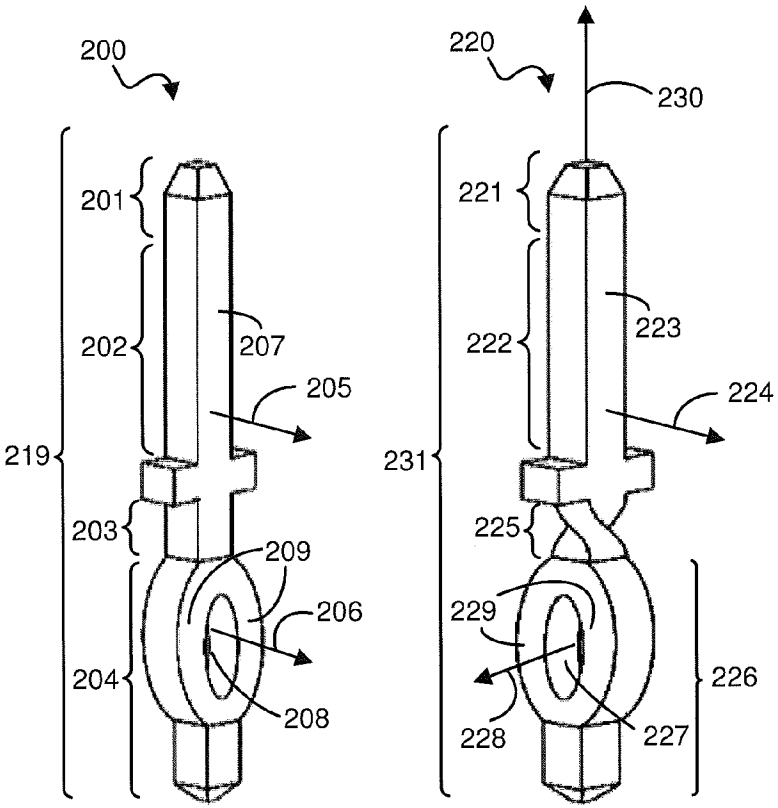
FIG. 2A depicts a twisted and untwisted compliant pin with a header segment, according to embodiments of the present disclosure.

Turning now to FIG. 2A, in embodiments, a male EON compliant pin 200 that includes an untwisted segment 203 and a male EON pin 220 that includes a twisted segment 225 can be seen, according to embodiments. In embodiments, the male EON compliant pin 200 can include a header segment 201 configured for insertion within a receptacle segment of a female EON compliant pin. The male EON compliant pin 200 can also include a length segment 202. The length segment 202 can include a first surface 207. A first normal 205 of the first surface 207 can project outward from the first surface and perpendicularly to the first surface. The male EON pin 200 can include the untwisted section 203 connected between a top portion of a compliant segment 204 and a bottom portion of the length segment 202. In embodiments, the compliant segment 204, the length segment 202, and the untwisted segment 203 can together form a substantially straight solid body 219. The compliant segment 204 can include two opposing spring arms 209. The two opposing spring arms 209 can define a substantially planar opening 208. A second normal 206 of the substantially planar opening 208 can project outward from the substantially planar opening 208 and perpendicularly to the opening 208, such that an angle between the first normal and the second normal is substantially zero degrees.

The male EON compliant pin 220 that includes a twisted segment 225 can include a header segment 221 configured for insertion within a receptacle segment. In embodiments, the twisted section 225 can be twisted about a longitudinal axis 230 of the compliant pin 220. The male EON compliant pin 220 can also include a length segment 222. The length segment 222 can include a second surface 223. A third normal 224 of the second surface 223 can project outward from the second surface 223 and perpendicularly to the second surface 223. The male EON pin 220 can further include a compliant segment 226 that includes two opposing spring arms 229. The two opposing spring arms can define a second substantially planar opening 227. A fourth normal 228 of the second substantially planar opening 227 can project outward from the second substantially planar opening 227 and perpendicularly to the substantially planar opening 227, such that a second angle between the third normal and the fourth normal is substantially ninety degrees. In embodiments, the second angle between the third normal and the fourth normal can include degrees between thirty degrees and one-hundred fifty degrees, e.g. thirty degrees, forty-five degrees, and sixty degrees. In some embodiments, the twisted segment can be higher up on the male EON compliant pin 220 than twisted segment 225 is depicted in FIG. 2A. In addition, such an embodiment can include a straight segment between the top portion of the compliant segment 226 and the higher twisted segment. In embodiments, the compliant segment 226, the length segment 222, and the untwisted segment 225 can form a substantially straight solid body 231.

Turning now to FIG. 2B, a female EON compliant pin 240 that includes an untwisted segment 245 and a female EON compliant pin 260 that includes a twisted section 265 can be seen, according to embodiments. In embodiments, the female EON compliant pin 240 can include a receptacle segment 241 that can include a pair of resiliently deflectable fingers 251. The pair of resiliently deflectable fingers 251 can be spaced apart a distance and can be configured for accepting a header segment, such as the header segments 201 or 221. The header segment 201, 221 can create a force by displacing each of the resiliently deflectable fingers 251 that can increase a frictional force. The increased frictional force between the header segment 201, 221 and the resiliently deflectable fingers 251 can increase the likelihood that the header segment 201, 221 stays in place within the resiliently deflectable fingers 251. In use, an electrical current can flow from the header segment 201, 221 to the receptacle segment 241. The female EON compliant pin 240 can also include a length segment 242. The length segment 242 can include a third surface 243. The third surface 243 can include a fifth normal 244. This fifth normal 244 can project outward from the third surface 243 and perpendicularly to the third surface 243. The female EON pin 240 can include the untwisted section 245 connected between a top portion of a compliant segment 246 and a bottom portion of the length segment 242. The compliant segment 246 can include two opposing spring arms 248. The two opposing spring arms 248 can define a third substantially planar opening 247. A sixth normal 249 of the third substantially planar opening 247 can project outward from the third substantially planar opening 247 and perpendicularly to the third substantially planar opening 247, such that a third angle between the fifth normal and the sixth normal is substantially zero degrees. The header segment 201 or 221 can be bent at an angle relative to the length segment 202 or 222. In embodiments, the relative angle can be, but is not limited to, a substantially right angle, or can be at an angle between ninety degrees and zero degrees. In some embodiments, male EON compliant pins 200 and 220 could have a substantially straight header segment 201 or 221.

The female EON compliant pin 260 that includes a twisted segment 265 can include a receptacle segment 261 that can include a pair of resiliently deflectable fingers 271. The pair of resiliently deflectable fingers 271 can be configured for accepting header segments, such as the header segments 201 and 221. In embodiments, the twisted section 265 can be twisted about a longitudinal axis 250 of the compliant pin 260. The female EON compliant pin 260 can also include a length segment 262. The length segment 262 can include a fourth surface 263. The fourth surface 263 can include a seventh normal 264 that can project outward from the fourth surface 263 and perpendicularly to the fourth surface 263. The twisted EON pin 260 can further include a compliant segment 266 that includes two opposing spring arms 268. The two opposing spring arms 268 can define a fourth substantially planar opening 267. An eighth normal 269 of the fourth substantially planar opening 267 can project outward from the fourth substantially planar opening 267 and perpendicularly to the fourth substantially planar opening 267, such that a fourth angle between the seventh normal and the eighth normal is substantially ninety degrees. In embodiments, the fourth angle between the seventh normal and the eighth normal can include degrees between thirty degrees and one-hundred fifty degrees, e.g., thirty degrees, forty-five degrees, and sixty degrees. In embodiments, the compliant segment 266, the length segment 262, and the twisted segment 265 can together form a substantially straight solid body 272. Further, the twisted segment can be higher up on the female EON compliant pin 260 than as depicted in FIG. 2B. Furthermore, in such embodiments, there could be a straight segment between the top portion of the compliant segment 266 above the two opposing spring arms 268 and the higher twisted segment. The receptacle segment 261 or 241 can be bent at an angle relative to the length segment 262 or 242. In embodiments, the relative angle can be, but is not limited to, a substantially right angle, or can be at an angle between ninety degrees and zero degrees. Female EON compliant pins 260 or 240 could have a substantially straight receptacle segment 261 or 241.

EON compliant pins can be housed within a connector body. A connector body can group multiple male EON compliant pins together and multiple female EON complaint pins together. Turning now to FIG. 3A, a connector body 301 housing a plurality of male compliant pins 200 after removal from an printed circuit board 303 can be seen, according to embodiments of the present disclosure. The connector body 301 can include an opening that can accept a receptacle segment, e.g. receptacle segment 241, to connect with the header segment 201 of the male EON compliant pin 200. The connector body 301 can house one or more EON compliant pins 200 in an array. The combination of a plurality of compliant pins 200 and the connector body 301 can be used in conjunction with the printed circuit board 303. Each of the EON compliant pins 200 can be inserted into an electrical via 302. In some embodiments, the printed circuit board 303 can include more electrical vias 302 than EON compliant pins 200 within the connector body 301. The printed circuit board 303 can include one or more electrical vias 302. Each of the EON compliant pins 200 can be inserted within an electrical via 302.

In some circumstances, for example, when a connector body is damaged or during routine maintenance, reworking could occur. Reworking can refer to a removal of EON pins from a printed circuit board and an insertion of new EON pins within the printed circuit board. Reworking can include replacing a plurality of EON compliant pins with a new plurality of EON compliant pins that include a twisted segment. This can be useful for reducing damage to electrical vias during reworking. A twisted segment can introduce a rotation that can result in an EON pin touching a different set of contact points on the inner rim of the electrical via than what was touched during a prior insertion of the same or different EON pin.

Figure 3B:
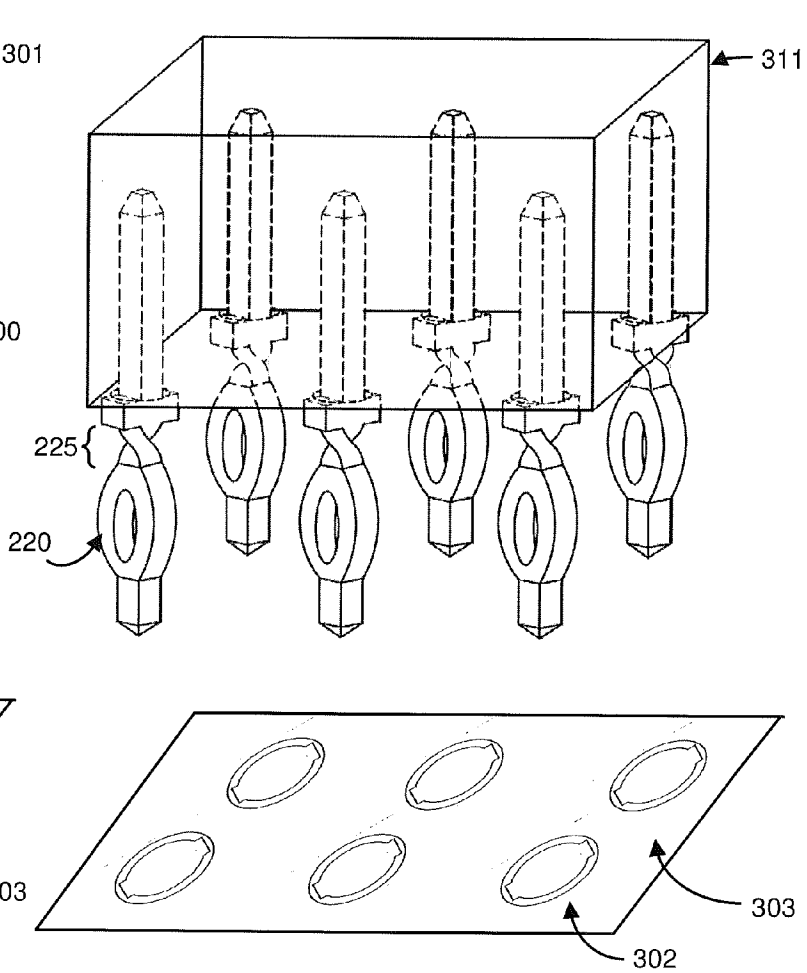
FIG. 3B depicts a plurality of twisted compliant pins including header segments within a connector body before being inserted into a printed circuit board containing a plurality of electrical vias, according to embodiments of the present disclosure.
Figure 3A:
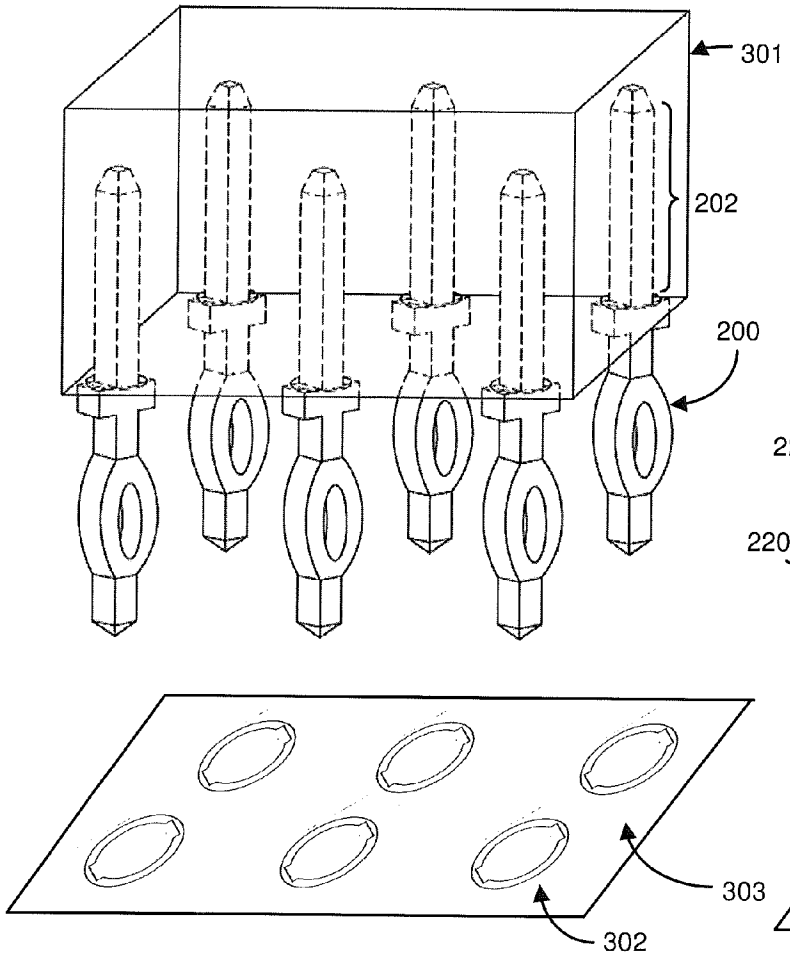
FIG. 3A depicts a plurality of untwisted compliant pins including header segments within a connector body after being removed from a printed circuit board containing a plurality of electrical vias, according to embodiments of the present disclosure.

Turning now to FIG. 3B, a connector body 311 housing a plurality of male compliant pins 220 before insertion into a printed circuit board 303 can be seen, according to embodiments of the present disclosure. This new plurality of male EON complaint pins 220 can be inserted into the printed circuit board 303 after the removal of the plurality of EON pins 200 from the printed circuit board 303 (shown in FIG. 3A). The new plurality of EON compliant pins 220 can each include a twisted segment that introduces a rotation between 30 degrees and 150 degrees as described in FIG. 2B. The rotation can be determined after examination of the inner surface of the electrical vias following the removal of the plurality of EON complain pins 200.

In embodiments, each twisted segment of each of the EON compliant pins 220 can result from a person or machine manually twisting each compliant segment 203 of the plurality of EON compliant pins 200 while each length segment 202 is fastened within the connector body 301. In embodiments, the connector body 311 housing the new plurality of EON compliant pins 220 can be the connector body 301 described in FIG. 3A. An additional example can be individually removing each of the plurality of EON compliant pins 200 from the connector body 301 and replacing the EON compliant pins 200 with the EON compliant pins 220 that include a twisted section 225. The connector body 311 can be a different connector body than connector body 301 and can include the plurality of EON compliant pins 200 that were manually twisted, or a permutation thereof. For example, the new connector body 311 can include EON compliant pins 220 that include a twisted section 225 with predetermined rotations, e.g. thirty degrees, forty-five degrees, or sixty degrees.

Determining the rotation can be after examining the electrical vias 302 of the printed circuit board 303 after removal of the plurality of EON complaint pins 200 during reworking, since the damage may not be consistent after every removal and the need for a different rotation may fluctuate. A person or instrument or combination thereof can examine the electrical via 302 and determine a needed rotation for reworking. This examining process can occur one or more times until most of the inner surface of the electrical via 302 has been in contact with one or more opposing spring arms. This reworking process using new EON compliant pins that include twisted segments could extend the life of a printed circuit board, hence saving resources. In either the connector body 301 or the connector body 311, the pins may not all be aligned with each other; also, in rotated pins, the amount of rotations may be different. Either connector body 301 or 311 can also house female EON compliant pins that include a receptacle segments, such as female EON compliant pins 240 and 260 as described in FIG. 2B.

Figure 4B:
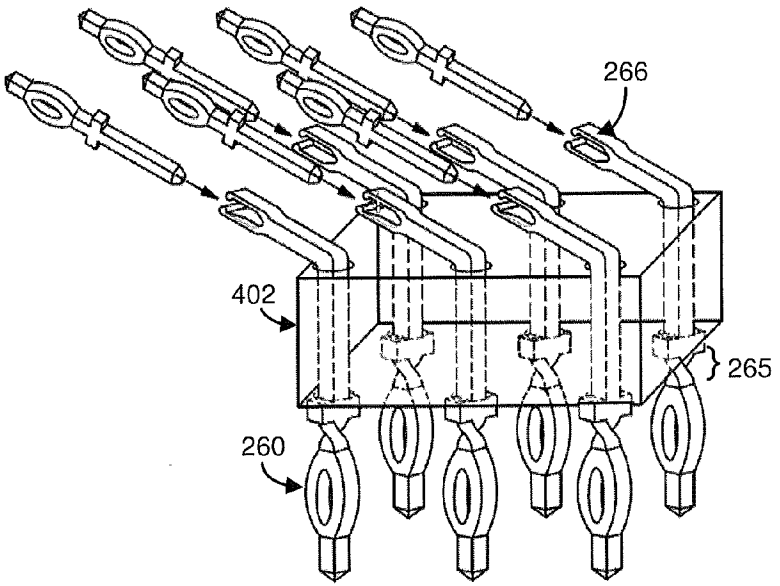
FIG. 4B depicts a plurality of twisted compliant pins including receptacle portions within a connector body, wherein each receptacle segment is shown mating with an untwisted compliant pin header segment before being inserted into a printed circuit board, according to embodiments of the present disclosure.
Figure 4B:
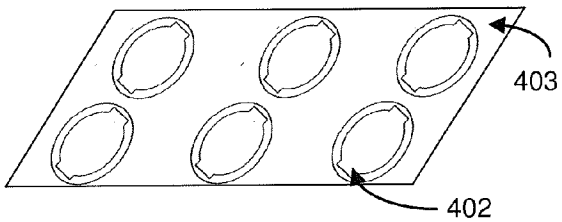
Figure 4A:
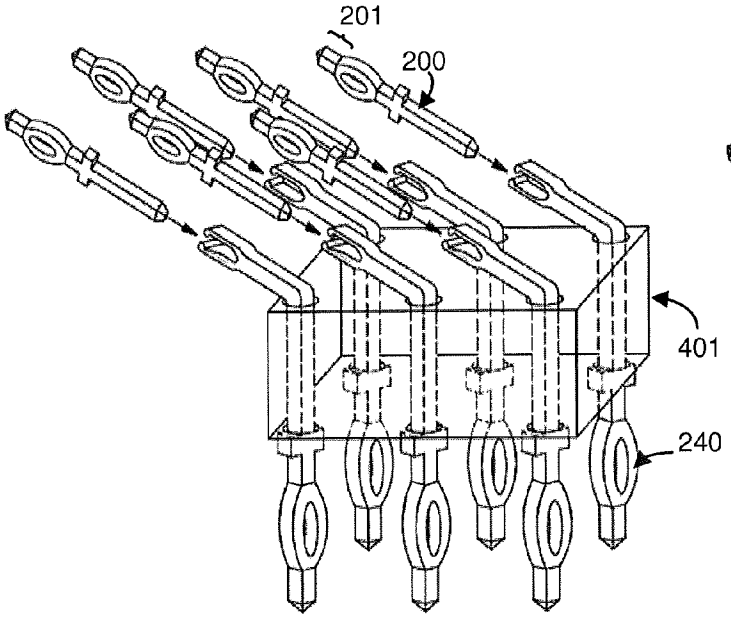
FIG. 4A depicts a plurality of untwisted compliant pins including receptacle segments within a connector body, wherein each receptacle segment is shown mating with an untwisted compliant pin header portion after being removed from a printed circuit board, according to embodiments of the present disclosure.
Figure 4A:
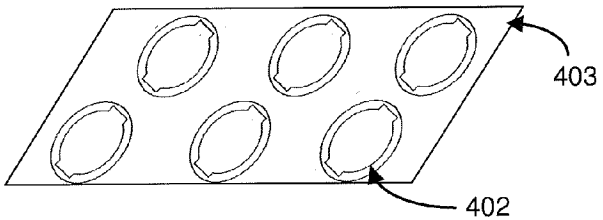

Turning now to FIG. 4A, a diagram of a connector body 401 housing a plurality of female compliant pins 240 after removal from an printed circuit board 403 can be seen, according to an embodiment of the present disclosure. The connector body 401 can include an opening that a receptacle segment 241 can protrude from that can accept a header segment, e.g., header segment 201 or 221, of the male EON compliant pin 200 or 220. The connector body 401 can house one or more female EON compliant pins 240 in an array. The combination of the plurality of female EON compliant pins 240 and the connector body 401 can be used in conjunction with the printed circuit board 403. Each of the female EON compliant pins 240 can be inserted into an electrical via 402. The printed circuit board 403 can include one or more electrical vias 402. The printed circuit board 403 can include more electrical vias 402 than female EON compliant pins 240.

In some circumstances, for example, during routine maintenance, when a connector body is damaged, or when some of a plurality of female EON compliant pins are damaged, reworking could occur. Removing this plurality of female EON compliant pins and inserting a new plurality of female EON pins could be difficult due to the receptacle segment. However, in embodiments, a person or machine can individually twist each of the plurality of the female EON pins in order to become substantially similar to the EON compliant pin 260 as described in FIG. 2B. Determining the rotation of the twisted segment can be substantially similar to the process described in FIG. 3A and FIG. 3B.

In some embodiments, an angled mating section (e.g., receptacle or header) could cause issues during reworking. The angled mating section can be included in a male or female EON compliant pin. Note that the EON compliant pin including an angled mating section may, in some situations, not be rotatable within or removable from the connector body. This can make reworking difficult. This could mean that twisting of the EON compliant might have to be done by manually twisting each EON compliant pin within the connector body. This could happen with any angled mating portion, whether male or female.

Turning now to FIG. 4B, a connector body 402 housing a new plurality of female EON compliant pins 260 before insertion into an printed circuit board 403 can be seen, according to embodiments of the present disclosure. This new plurality of female EON compliant pins 260 can be inserted into the printed circuit board 403 after removing the plurality of female EON pins 240 from the printed circuit board 403. In embodiments, this new plurality of female EON complaint pins 260 can include twisted segments 265. In some embodiments, the twisted segments can introduce a rotation between thirty degrees and one-hundred fifty degrees as described in FIG. 2B. For example, the new connector body 402 can include female EON compliant pins 260 that include twisted sections with rotations of thirty degrees, forty-five degrees, or sixty degrees. The predetermined rotation can be determined after examining the electrical vias 402 subsequent to removal of the plurality of female EON complaint pins 240. In some embodiments, examination of the electrical vias 402 can be necessary since the damage may not be consistent after every removal and the need for a different rotation may fluctuate. A person or instrument or combination thereof can examine the electrical via 402 and determine the rotation needed for the twisted segments 265 during reworking. This examining process can occur one or more times until most of a surface of the inner rim of the electrical via 402 has been in contact with one or more opposing spring arms, e.g. opposing spring arms 266. This process could extend the life of printed circuit board 403.

In some embodiments, the new plurality of EON pins 260 could be fabricated after examination. The rotation of the twisted segment 265 could be determined after examination. Fabrication of EON compliant pins that include twisted segments can be accomplished in various ways. Manually twisting may not be necessary to provide the twisted segments that introduce rotation. Instead, the twisted segment may be provided by changing a stamp and form orientation within die operations. In embodiments, combination process options provide eye of needle orientation changes as well. For example, a combination process can include utilizing a stamp to initially fabricate the twisted segment then follow with manually twisting the twisted segment further. In some embodiments, instruments with different compliant pin orientations can be made by making simple changes in a progressive die tooling used to stamp and form of the twisted segment for a particular rotation. In some embodiments, a twisting step can be staged at a convenient point within progressive die stamping, bending, forming, and coining steps that can be used to fabricate an EON compliant pin. A set of EON compliant pins that include a twisted section can be assembled within a connector body following fabrication of the EON compliant pins.

Figure 5:
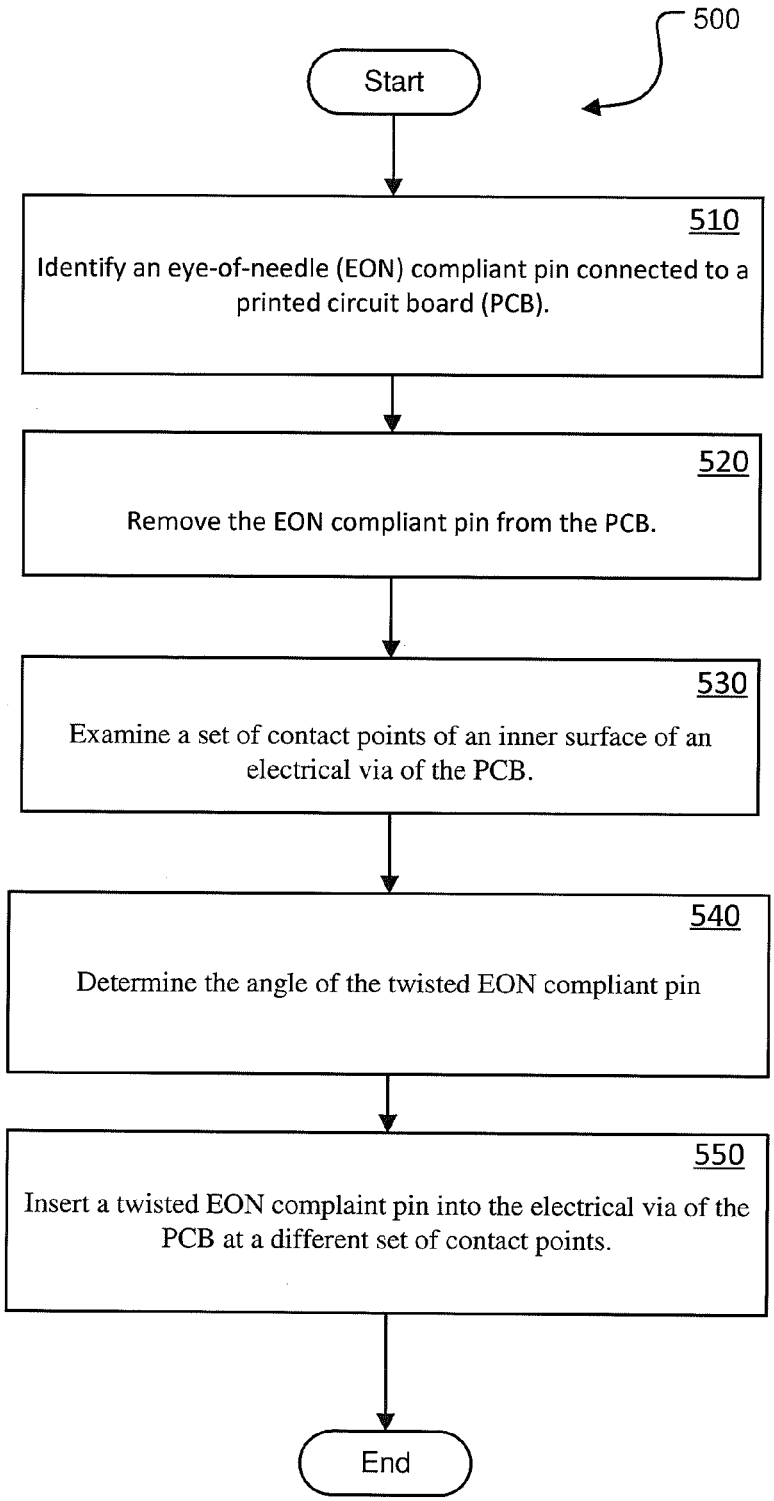
FIG. 5 depicts a method of removing an eye-of-needle (EON) compliant pin from a printed circuit board (PCB) then inserting a twisted EON compliant pin into the PCB, according to embodiments of the present disclosure.

Now turning to FIG. 5, a method 500 for reworking can be seen, according to various embodiments. In embodiments, the method 500 can include, in operation 510, identifying an eye-of-needle (EON) compliant pin connected to a printed circuit board (PCB). The EON compliant pin can be comprised of a conductive material, e.g. gold, silver, copper, or aluminum. In embodiments, the PCB can be an electronic circuit consisting of thin strips of a conducting material such as copper to which integrated circuits and other components can be attached. The PCB can be a part of a computer or electronic computing device. The EON compliant pin can be connected to the PCB to maintain or redirect an electrical current. The EON compliant pin can include a header segment (male EON compliant pin) or a receptacle segment (female EON compliant pin). In embodiments, once operation 510 has identified the EON compliant pin, the method 500 can proceed to an operation 520.

In embodiments, operation 520 can include removing the EON compliant pin from the PCB. Removing can be accomplished by a human or a machine. Removing the EON compliant pin may be due to routine maintenance. Routine maintenance may be caused by the PCB needing to be repaired, or as a result of the EON compliant pin having been damaged. The PCB may need to be repaired if electrical vias of the PCB are damaged from the EON compliant pins exerting a normal force upon the electrical via's inner surface. The electrical via's inner surface can be damaged during removal of the EON compliant pin. In embodiments, once operation 520 has removed the EON compliant pin from the PCB, the method 500 can proceed to an operation 530.

In embodiments, operation 530 can include examining a set of contact points of an inner surface of the electrical via of the PCB. The set of contact points can be from a pair of opposing spring arms of the EON compliant pin engaging the inner surface of the electrical via. Examining the set of contact points can be to determine a twisted EON compliant pin to insert into the PCB that includes a twisted segment. The twisted segment can include a rotation such that a second pair of opposing spring arms of the twisted EON compliant pin can engage the electrical via at a different set of contact points. In embodiments, the second pair of opposing spring arms can be the pair of opposing spring arms, e.g., if the twisted segment is caused by manually twisting the EON pin after removal in operation 520. Examining can increase the life of the electrical via, since repeated removal and insertion of EON compliant pins can cause electrical vias to crack. In embodiments, once operation 530 has examined the electrical vias, the method 500 can proceed to an operation 540.

In embodiments, operation 540 can include determining an angle of a twisted segment of a twisted EON compliant pin, e.g. 220 or 260 as described in FIG. 2A and FIG. 2B, respectively. In embodiments, the angle could be enough so that the second pair of opposing spring arms can engage the inner surface of the electrical via at a different set of contact points from the first set of contact points. In embodiments, the angle can be based on the examining of the electrical vias in operation 530. In embodiments, the angle can range from thirty degrees to one hundred fifty degrees. In embodiments, once the angle has been determined in operation 540, the method 500 can proceed to an operation 550.

In embodiments, the operation 550 can include inserting the twisted EON complaint pin into the electrical via of the PCB. In embodiments, the second pair of opposing spring arms can engage the inner surface of the electrical via at the different set of contact points. In embodiments, the twisted EON compliant pin can be the EON compliant pin that was removed and then manually twisted. In embodiments, the twisted EON compliant pin can be a different EON compliant pin. In embodiments, the method 500 can repeat more than once. The method 500 can repeat until opposing spring arms have engaged all contact points of the inner surface of the electrical via. For example, the method 500 can include a twisted EON compliant pin that include a thirty degree rotation, and then repeat with a second EON compliant pin with a second rotation of sixty degrees, and so on. In other embodiments, once the twisted EON compliant pin has been inserted into the electrical via in operation 550, the method 500 can conclude until a following reworking.

Figure 6:
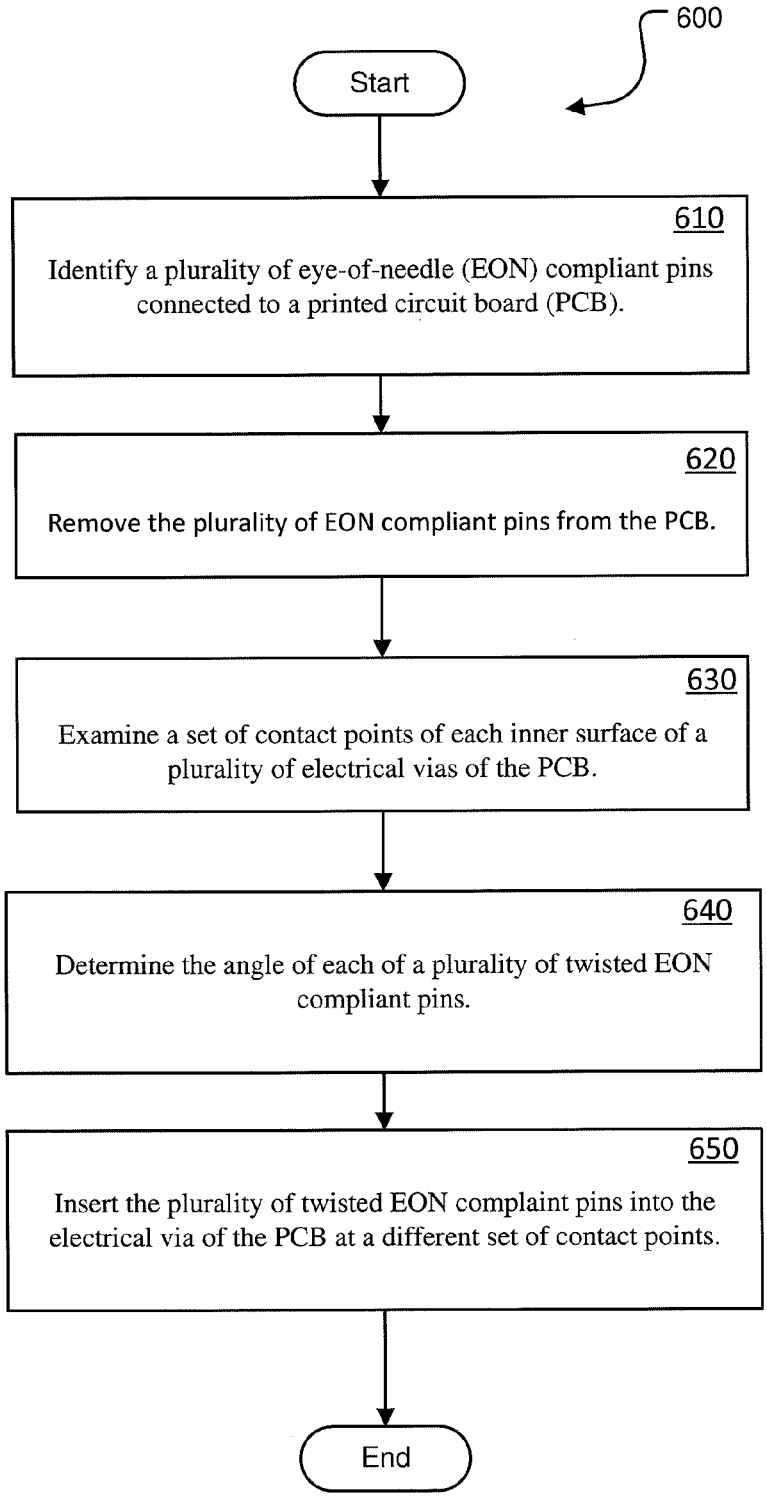
FIG. 6 depicts a method of removing a plurality eye-of-needle (EON) compliant pins from a printed circuit board (PCB) then inserting a plurality of twisted EON compliant pin into the PCB, according to embodiments of the present disclosure.

Reworking can also include a plurality of EON compliant pins that are housed within a connector body. Now turning to FIG. 6, a method 600 for reworking including a plurality of EON pins can be seen, according to various embodiments. In embodiments, method 600 can include, in operation 610, identifying a plurality of eye-of-needle (EON) compliant pins connected to a printed circuit board (PCB). The plurality of EON compliant pins can be substantially similar to the EON compliant pins 200 and 240 described in FIG. 3A and FIG. 3B, respectively. A connector body, e.g., the connector body 301 or 401 as described in FIG. 3A and FIG. 4A, can house the plurality of EON compliant pins. Each pin of the plurality of EON pins can be within an electrical via of the PCB. The PCB can include more electrical vias than the plurality of EON pins. More than one connector body housing a plurality of EON pins can be connected to the PCB. The electrical vias can be in an array. The electrical vias can each comprise a conducting material that can maintain an electrical current with an EON compliant pin. The EON complaint pin can comprise a different conducting material than the electrical via. In embodiments, once operation 610 has identified the plurality of EON pins connected to the PCB, the operation 610 can proceed to an operation 620.

In embodiments, operation 620 can include removing the plurality of EON compliant pins from the PCB. A human or machine can remove the plurality of EON pins from the PCB. Removing the plurality of EON compliant pins may be due to routine maintenance. Routine maintenance may be caused by the PCB needing to be repaired, or the one or more of plurality of EON compliant pins could be damaged. The PCB may need to be repaired if electrical vias of the PCB are damaged from the EON compliant pins exerting normal forces upon the electrical vias' inner surfaces. An electrical via's inner surface can be damaged during pin removal. In embodiments, once operation 620 has removed the plurality of EON compliant pins from the PCB, the operation 620 can proceed to an operation 630.

In embodiments, operation 630 can include examining a set of contact points of inner surface of each via of the plurality of electrical vias of the PCB. In embodiments, each set of contact points can be from a pair of opposing spring arms of a pin of the plurality EON compliant pins engaging the inner surface of the electrical via. Examining the set of contact points can be to determine a twisted EON compliant pin to insert into the PCB that includes a twisted segment, as described in operation 650. Each twisted segment can include a rotation such that a second pair of opposing spring arms of each twisted EON compliant pin can engage an electrical via at a different set of contact points than the first set of contact points within that via. In embodiments, the second pair of opposing spring arms can be the pair of opposing spring arms that were removed from the PCB, e.g. if the twisted segment is caused by manually twisting each of the plurality of EON compliant pins after removal in operation 620. Examining can increase the life of the electrical via, since repeated removal and insertion of the plurality of EON compliant pins can cause the electrical vias to crack. In embodiments, once operation 630 has examined the plurality of EON pins, operation 630 can proceed to an operation 640.

In embodiments, operation 640 can include determining the angle of each pin of the plurality of twisted EON compliant pins, as described in FIG. 3B and FIG. 4B. In embodiments, the angle of each EON pin could be enough so that the second pair of opposing spring arms can engage the inner surface of the electrical via at a different set of contact points. In embodiments, the angle can be based on the examining of the electrical vias in operation 630. In embodiments, the angle can range from thirty degrees to one hundred fifty degrees. In embodiments, a second pair of opposing spring arms can engage an electrical via at another different set of contact points than another second pair of opposing spring arms. This means that each determined angle for each EON compliant pins can differ. In embodiments, once the operation 640 has determined the angle for each of the plurality of EON compliant pins, the operation 640 can proceed to an operation 650.

In embodiments, operation 650 can include inserting each pin of the plurality of twisted EON complaint pins into an electrical via of the PCB at a different set of contact points. In embodiments, a human or machine can manually twist each of the plurality of EON compliant pins, or replace each of the plurality of EON compliant pins with a plurality of twisted EON compliant pins. In embodiments, the connector body housing the plurality of twisted EON compliant pins can be the same connector body housing the plurality of EON compliant pins. In embodiments, a different connector body can be housing the plurality of twisted EON pins. In embodiments, the twisted section of each twisted EON compliant pin can range from thirty degrees to one hundred fifty degrees. In embodiments, the method 600 can repeat more than once. The method 600 can repeat until opposing spring arms of each EON compliant pin have engaged all contact points of each of the inner surfaces. For example, the method 600 can include a first plurality of twisted EON compliant pins that include a thirty degree rotation, and then repeat with a second plurality of twisted EON compliant pins with a second rotation of sixty degrees, and so on. In some embodiments, once the twisted plurality of EON compliant pins have been inserted into the electrical vias in operation 650, the method 600 can conclude until a following reworking.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. An eye-of-needle (EON) compliant pin comprising:

a compliant segment comprising two opposing spring arms defining a substantially planar opening; and a twisted segment connected between a top portion of the compliant segment and a bottom portion of a length segment, wherein the compliant segment, the length segment, and the twisted segment together form a substantially straight solid body, and wherein the twisted segment is twisted about a longitudinal axis of the substantially straight solid body such that the substantially planar opening of the compliant segment is rotated at an angle with respect to the length segment.

2. The EON compliant pin of claim 1, wherein the angle is between thirty degrees and one-hundred fifty degrees.

3. The EON compliant pin of claim 1 further comprising:

a header segment extending substantially straight from a top portion of the length segment, the header segment including a mating slot configured to mate an electrical contact of a receptacle segment.

4. The EON compliant pin of claim 1 further comprising:

a receptacle segment extending at a substantially right angle from a top portion of the length segment, the receptacle segment including a pair of resiliently deflectable fingers that are spaced apart to define a mating slot configured to mate an electrical contact of a header segment.

5. A method comprising:

identifying an eye-of-needle (EON) compliant pin connected to a printed circuit board (PCB);

removing the EON compliant pin from the PCB, wherein the EON complaint pin created a set of contact points where two opposing spring arms of the EON compliant pin were engaging an inner surface of an electrical via of the PCB;

inserting a twisted EON complaint pin into the electrical via of the PCB at a different set of contact points, the twisted EON compliant pin comprising:

a compliant segment comprising two opposing spring arms defining a substantially planar opening; and a twisted segment connected between a top portion of the compliant segment and a bottom portion of a length segment, wherein the compliant segment, the length segment, and the twisted segment together form a substantially straight solid body, and wherein the twisted segment is twisted about a longitudinal axis of the substantially straight solid body such that the substantially planar opening of the compliant segment is rotated at an angle with respect to the length segment.

6. The method of claim 5, the method further comprising:

examining the set of contact points where the two opposing spring arms of the EON compliant pin were engaging the inner surface of the electrical via of the PCB.

7. The method of claim 6, the method further comprising:

determining, based on the examining the set of contact points, the angle of the twisted EON compliant pin.

8. The method of claim 5, wherein the EON compliant pin further comprises:

a first compliant segment comprising two opposing first spring arms defining a first substantially planar opening;

a top portion of the first compliant segment connected to a bottom portion of a first length segment; and wherein the compliant segment and the length segment together form a substantially straight solid body.

9. The method of claim 5, wherein the angle is between thirty degrees and one-hundred fifty degrees.

10. The method of claim 5, wherein the twisted EON compliant pin further comprises:

a header segment extending substantially straight from a top portion of the length segment, the header segment including a mating slot configured to mate an electrical contact of a receptacle segment.

11. The method of claim 5, wherein the twisted EON compliant pin further comprises:

a receptacle segment extending at a substantially right angle from a top portion of the length segment, the receptacle segment including a pair of resiliently deflectable fingers that are spaced apart to define a mating slot configured to mate an electrical contact of a header segment.

12. A method comprising:

identifying a plurality of eye-of-needle (EON) compliant pins connected to a printed circuit board (PCB), wherein a connector body houses the plurality of EON pins;

removing the plurality of EON compliant pins from the PCB, wherein a plurality of sets of contact points were created where two opposing spring arms of each of the plurality of EON compliant pins were engaging in corresponding inner surfaces of each of a plurality of electrical vias of the PCB;

inserting a plurality of twisted EON complaint pins into the corresponding plurality of electrical vias of the PCB at a plurality of different sets of contact points, each of the plurality of twisted EON compliant pins comprising:

a compliant segment comprising two opposing spring arms defining a substantially planar opening; and a twisted segment connected between a top portion of the compliant segment and a bottom portion of a length segment, wherein the compliant segment, the length segment, and the twisted segment together form a substantially straight solid body, and wherein the twisted segment is twisted about a longitudinal axis of the substantially straight solid body such that the substantially planar opening of the compliant segment is rotated at an angle with respect to the length segment.

13. The method of claim 12, wherein a second connector body houses the plurality of twisted EON compliant pins.

14. The method of claim 12, wherein the connector body houses the plurality of twisted EON compliant pins.

15. The method of claim 14, the method further comprising:

removing each EON compliant pin in the plurality of compliant pins from the connector body;

examining the plurality of sets of contact points;

inserting each of the plurality of twisted EON compliant pins into the connector body.

16. The method of claim 14, the method further comprising:

twisting, based on the examining, each of the EON compliant pins of the plurality of compliant pins.

17. The method of claim 12, the method further comprising:

determining, based on the examining the plurality of sets of contact points, the angle of each of the twisted EON compliant pins.

18. The method of claim 12, wherein each angle is between thirty degrees and one-hundred fifty degrees.

19. The method of claim 12, wherein each of the twisted EON compliant pins further comprises:

a header segment extending substantially straight from a top portion of the length segment, the header segment including a mating slot configured to mate an electrical contact of a receptacle segment.

20. The method of claim 12, wherein each of the twisted EON compliant pins further comprises:

a receptacle segment extending at a substantially right angle from a top portion of the length segment, the receptacle segment including a pair of resiliently deflectable fingers that are spaced apart to define a mating slot configured to mate an electrical contact of a header segment.

* * * * *